US011024108B2

(12) United States Patent
Nagashima et al.

(10) Patent No.: US 11,024,108 B2
(45) Date of Patent: Jun. 1, 2021

(54) COIN DETECTION ANTENNA AND COIN PROCESSING DEVICE

(71) Applicant: FUJI ELECTRIC CO., LTD., Kawasaki (JP)

(72) Inventors: Ryuuichi Nagashima, Yokkaichi (JP); Michiru Fujita, Ichihara (JP); Hirotaka Yoshimatsu, Yokkaichi (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 120 days.

(21) Appl. No.: 16/139,576

(22) Filed: Sep. 24, 2018

(65) Prior Publication Data

US 2019/0164370 A1 May 30, 2019

(30) Foreign Application Priority Data

Nov. 27, 2017 (JP) ..... JP2017-226884

(51) Int. Cl.

| | |
|---|---|
| ***G07D 5/02*** | (2006.01) |
| ***H01Q 1/36*** | (2006.01) |
| ***H01Q 9/27*** | (2006.01) |
| ***G07F 1/02*** | (2006.01) |
| ***H01F 27/29*** | (2006.01) |
| ***G07D 3/00*** | (2006.01) |
| ***G07D 5/08*** | (2006.01) |
| ***H01F 5/00*** | (2006.01) |
| ***G07D 3/14*** | (2006.01) |
| *G07F 5/24* | (2006.01) |

(52) U.S. Cl.

CPC ..... *G07D 5/02* (2013.01); *G07D 3/00* (2013.01); *G07D 3/14* (2013.01); *G07D 5/08* (2013.01); *G07F 1/02* (2013.01); *H01F 5/003* (2013.01); *H01F 27/292* (2013.01); *H01Q 1/36* (2013.01); *H01Q 9/27* (2013.01); *G07F 5/24* (2013.01)

(58) Field of Classification Search

CPC .. G07D 5/02; G07D 3/00; G07D 5/08; G07D 3/14; G07D 5/10; G07D 9/02; G07F 1/02; G07F 5/24; H01Q 1/36; H01Q 9/27; H01F 5/003; H01F 27/292; H01F 21/005

USPC ..... 194/317–320

See application file for complete search history.

(56) References Cited

U.S. PATENT DOCUMENTS

| | | | | |
|---|---|---|---|---|
| 3,901,368 A * | 8/1975 | Klinger | ..... | G07D 5/08 194/317 |
| 4,353,453 A * | 10/1982 | Partin | ..... | G07D 5/08 194/319 |
| 4,441,602 A * | 4/1984 | Ostroski | ..... | G07D 5/02 194/318 |
| 4,574,936 A * | 3/1986 | Klinger | ..... | G07D 5/08 194/318 |

(Continued)

FOREIGN PATENT DOCUMENTS

JP 2017-058861 A 9/2015

*Primary Examiner* — Jeffrey A Shapiro

(74) *Attorney, Agent, or Firm* — Manabu Kanesaka

(57) ABSTRACT

A coin detection antenna includes a substrate and a plurality of air core coils of track shape including a wiring pattern provided on the substrate. The plurality of air core coils is disposed along short-side directions of air cores of the plurality of air core coils such that a smallest coin of coins to be detected crosses at least one of centerlines of the air cores even when the smallest coin is located at any location in a detection range.

11 Claims, 4 Drawing Sheets

(56) References Cited

U.S. PATENT DOCUMENTS

| | | | | |
|---|---|---|---|---|
| 4,593,245 | A * | 6/1986 | Viertl | G01N 27/9033 324/238 |
| 4,678,994 | A * | 7/1987 | Davies | G07D 5/08 194/317 |
| 5,293,980 | A * | 3/1994 | Parker | G07D 5/08 194/317 |
| 5,411,126 | A * | 5/1995 | Seitz | G07D 5/08 194/317 |
| 5,799,768 | A * | 9/1998 | Bernier | G07D 3/00 194/318 |
| 6,340,082 | B1 * | 1/2002 | House | G07D 5/005 194/317 |
| 6,640,955 | B1 * | 11/2003 | Furuya | G07D 5/005 194/317 |
| 6,668,999 | B2 * | 12/2003 | Ohtomo | G07D 5/02 194/302 |
| 8,013,600 | B1 * | 9/2011 | Yepez, III | G01N 27/9033 324/240 |
| 2004/0130318 | A1 * | 7/2004 | Saltsov | G01D 5/204 324/207.17 |
| 2004/0144617 | A1 * | 7/2004 | Chien | G07D 5/00 194/318 |
| 2005/0150741 | A1 * | 7/2005 | Yamakawa | G07D 5/005 194/320 |
| 2007/0039800 | A1 * | 2/2007 | Bell | G07D 5/08 194/229 |
| 2016/0260276 | A1 * | 9/2016 | Yamada | G07D 5/08 |
| 2018/0072166 | A1 * | 3/2018 | Percebon | B60L 53/124 |

* cited by examiner

COIN DETECTION ANTENNA AND COIN PROCESSING DEVICE

CROSS-REFERENCE TO RELATED APPLICATION

The present application claims a priority of Japanese Patent Application number JP2017-226884, Coin Detection Antenna and Coin Processing Device, filed Nov. 27, 2017, the disclosure of which is hereby incorporated by reference.

BACKGROUND OF THE INVENTION

Field of the Invention

The present invention relates to a coin detection antenna and a coin processing device, and more particularly, it relates to a coin detection antenna and a coin processing device each including an air core coil.

Description of the Background Art

A coin processing device including an air core coil is known in general, as disclosed in Japanese Patent Laid-Open No. 2017-058861, for example.

Japanese Patent Laid-Open No. 2017-058861 discloses a coin change machine (coin processing device) that performs input and output of coins. The coin change machine includes a coin slot through which coins are inserted, and a tray to which coins are discharged. A sensor element that detects whether or not coins remain in the tray is disposed at a lower portion of the tray. The sensor element includes a substrate and a spiral coil (air core coil) provided on a surface of the substrate. The spiral coil is a coil including a spiral wiring pattern, and includes a U-shaped air core as a space where a coil is not wound on the innermost side of the spiral.

However, in the sensor element of the coin change machine disclosed in Japanese Patent Laid-Open No. 2017-058861, the air core is U-shaped, and thus coins can be detected in a wide range, but sensitivity disadvantageously varies depending on the positions of the coins relative to the air core coil.

SUMMARY OF THE INVENTION

The present invention has been proposed in order to solve the aforementioned problem, and an object of the present invention is to provide a coin detection antenna and a coin processing device, capable of detecting coins in a wide range while significantly reducing or preventing variations in sensitivity.

In order to attain the aforementioned object, a coin detection antenna according to a first aspect of the present invention includes a substrate and a plurality of air core coils of track shape including a wiring pattern provided on the substrate, and the plurality of air core coils is disposed along short-side directions of air cores of the plurality of air core coils such that a smallest coin of coins to be detected crosses at least one of centerlines of the air cores even when the smallest coin is located at any location in a detection range.

As described above, the coin detection antenna according to the first aspect of the present invention includes the plurality of air core coils of track shape such that the coins can be detected in a wide range as compared with the case where the coin detection antenna includes only one air core coil of track shape. Furthermore, the plurality of air core coils is disposed along the short-side directions of the air cores of the air core coils such that the smallest coin of the coins to be detected crosses at least one of the centerlines of the air cores even when the smallest coin is located at any location in the detection range, and thus the coins to be detected can surely be located at the edges of the air cores having high sensitivity within the detection range. Consequently, even when the plurality of air core coils of track shape is used, variations in sensitivity depending on the positions of the coins relative to the air core coils can be significantly reduced or prevented. Consequently, when the plurality of air core coils of track shape is used, the coins can be detected in a wide range while variations in sensitivity are significantly reduced or prevented. Furthermore, in order to detect the coins in a wide range, it is only necessary to provide one substrate on which the plurality of air core coils is provided, and it is not necessary to provide a plurality of substrates on which the air core coils are provided, and thus the structural complexity of the coin detection antenna can be significantly reduced or prevented. Furthermore, the plurality of air core coils is disposed along the short-side directions of the air cores such that generation of a dead space can be prevented as little as possible, and thus the size of the substrate can be reduced. Consequently, even when the plurality of air core coils is provided, the size of the coin detection antenna can be reduced.

In the aforementioned coin detection antenna according to the first aspect, a number of the plurality of air core coils preferably satisfies a formula (1): $a/b-1 \leq x < a/b$ where a represents a length of the detection range along the short-side directions of the air cores, b represents a diameter of the smallest coin, and x represents the number of the plurality of air core coils.

According to this structure, even when the smallest coin is located at any location in the detection range, the condition that the smallest coin crosses at least one of the centerlines of the air cores of the air core coils can be satisfied with a minimum number of air core coils. Consequently, the coins can be detected in a wide range with a minimum number of air core coils. Furthermore, even when the plurality of air core coils is provided, the size of the coin detection antenna can be further reduced.

In the aforementioned coin detection antenna according to the first aspect, air core coils disposed at opposite ends of the plurality of air core coils are preferably disposed such that each of distances between centerlines of air cores of the air core coils disposed at the opposite ends and outer edges of the detection range along the short-side directions is less than a diameter of the smallest coin, and air core coils adjacent to each other of the plurality of air core coils are preferably disposed such that a distance between centerlines of air cores of the air core coils adjacent to each other along the short-side directions is less than the diameter of the smallest coin. According to this structure, the plurality of air core coils 54 can be reliably disposed at a location where the condition that the smallest coin crosses at least one of the centerlines of the air cores of the air core coils even when the smallest coin is located at any location in the detection range is satisfied.

In this case, the air core coils disposed at the opposite ends are preferably disposed such that the distances between the centerlines of the air cores of the air core coils disposed at the opposite ends and the outer edges of the detection range along the short-side directions satisfy a formula (2): $a/(x+1)>c$ where a represents a length of the detection range along the short-side directions of the air cores, c represents the distances between the centerlines of the air cores of the air core coils disposed at the opposite ends and the outer edges of the detection range along the short-side directions of the air cores, and x represents a number of the plurality of air core coils.

According to this structure, the distances between the centerlines of the air cores and the outer edges of the detection range along the short-side directions of the air cores can be reduced as small as possible. Consequently, when the coins are disposed on the outer edge side of the detection range, the percentages of portions of the coins that cross the centerline of an air core of an air core coil disposed closest to the side on which the coins are disposed can be increased. Thus, even when the coins are disposed on the outer edge side of the detection range, the sensitivity can be increased as much as possible.

In the aforementioned structure in which the air core coils disposed at the opposite ends of the plurality of air core coils are disposed such that each of the distances between the centerlines of the air cores and the outer edges of the detection range along the short-side directions is less than the diameter of the smallest coin, the air core coils disposed at the opposite ends are preferably disposed such that the distances between the centerlines of the air cores of the air core coils disposed at the opposite ends and the outer edges of the detection range along the short-side directions satisfy a formula (3): $a/(x+1)<c$ where a represents a length of the detection range along the short-side directions of the air cores, c represents the distances between the centerlines of the air cores of the air core coils disposed at the opposite ends and the outer edges of the detection range along the short-side directions of the air cores, and x represents a number of the plurality of air core coils.

According to this structure, the distances between the centerlines of the air cores and the outer edges of the detection range along the short-side directions of the air cores can be increased as much as possible. Consequently, distances between the outer edges of the detection range and the outer edges of the substrate can be increased as much as possible, and thus the size of the substrate can be reduced with respect to the detection range.

In the aforementioned coin detection antenna according to the first aspect, the plurality of air core coils is preferably disposed along the short-side directions of the air cores such that the air core coils in which current flow directions in adjacent portions are opposite to each other are adjacent to each other when a size of a gap between the air core coils adjacent to each other is larger than a width of each of the air cores in the short-side directions. Here, when the size of the gap between the adjacent air core coils is larger than the width of each of the air cores in the short-side directions (i.e., when the air core coils are disposed away from each other), the air core coils in which the current flow directions in the adjacent portions are the same as each other are adjacent to each other such that magnetic fields are generated in the directions in which the magnetic fields cancel out each other in the gap between the adjacent air core coils. When magnetic fields are generated in the directions in which the magnetic fields cancel out each other, the sensitivity is disadvantageously reduced. Therefore, as described above, the plurality of air core coils is disposed along the short-side directions of the air cores such that the air core coils in which the current flow directions in the adjacent portions are opposite to each other are adjacent to each other when the size of the gap between the adjacent air core coils is larger than the width of each of the air cores in the short-side directions, and thus magnetic fields can be generated in the directions in which the magnetic fields do not cancel out each other (in the directions in which the magnetic fields strengthen each other) in the gap between the adjacent air core coils. Consequently, sufficient sensitivity for detecting the coins can be ensured also in the gap between the adjacent air core coils.

In the aforementioned coin detection antenna according to the first aspect, the plurality of air core coils is preferably disposed along the short-side directions of the air cores such that the air core coils in which current flow directions in adjacent portions are same as each other are adjacent to each other when a size of a gap between the air core coils adjacent to each other is smaller than ½ of a width of each of the air cores in the short-side directions. Here, when the size of the gap between the air core coils is smaller than ½ of the width of each of the air cores in the short-side directions (i.e., when the air core coils are disposed close to each other), the air core coils in which the current flow directions in the adjacent portions are opposite to each other are adjacent to each other such that magnetic fields are generated in the directions in which the magnetic fields cancel out each other in the gap between the adjacent air core coils. When magnetic fields are generated in the directions in which the magnetic fields cancel out each other, the sensitivity is disadvantageously reduced. Therefore, as described above, the plurality of air core coils is disposed along the short-side directions of the air cores such that the air core coils in which the current flow directions in the adjacent portions are the same as each other are adjacent to each other when the size of the gap between the adjacent air core coils is smaller than the width of each of the air cores in the short-side directions, and thus a magnetic field can be generated to connect the air cores of the adjacent air core coils. Consequently, sufficient sensitivity for detecting the coins can be ensured also in the gap between the adjacent air core coils.

In the aforementioned coin detection antenna according to the first aspect, the plurality of air core coils is preferably connected in series. According to this structure, the air core coils can be connected to each other with a simple structure as compared with the case where the plurality of air core coils is connected in parallel.

A coin processing device according to a second aspect of the present invention includes a coin retaining unit and a coin detection antenna provided at a location corresponding to the coin retaining unit, the coin detection antenna includes a substrate and a plurality of air core coils of track shape including a wiring pattern provided on the substrate, and the plurality of air core coils is disposed along short-side directions of air cores of the plurality of air core coils such that a smallest coin of coins to be detected crosses at least one of centerlines of the air cores even when the smallest coin is located at any location in a detection range.

In the coin processing device according to the second aspect of the present invention, as described above, the plurality of air core coils is disposed along the short-side directions of the air cores of the plurality of air core coils such that the smallest coin of the coins to be detected crosses at least one of the centerlines of the air cores even when the smallest coin is located at any location in the detection range. Thus, similarly to the aforementioned coin detection antenna according to the first aspect, even when the plurality of air core coils of track shape is used, the coins can be detected in a wide range while variations in sensitivity are significantly reduced or prevented. Furthermore, in order to detect the coins in a wide range, it is only necessary to provide one substrate on which the plurality of air core coils is provided, and it is not necessary to provide a plurality of substrates on which the air core coils are provided, and thus the structural complexity of the coin detection antenna can be significantly reduced or prevented. Furthermore, the plurality of air core coils is disposed along the short-side directions of the air cores such that generation of a dead space can be prevented as small as possible, and thus the size of the substrate can be reduced. Consequently, even when the plurality of air core coils is provided, the coin processing device capable of reducing the size of the coin detection antenna can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are hereinafter described with reference to the drawings.

The structure of a coin processing device (change machine) 100 according to the embodiment is now described with reference to FIGS. 1 to 6.

(Structure of Coin Processing Device)

Figure 1:
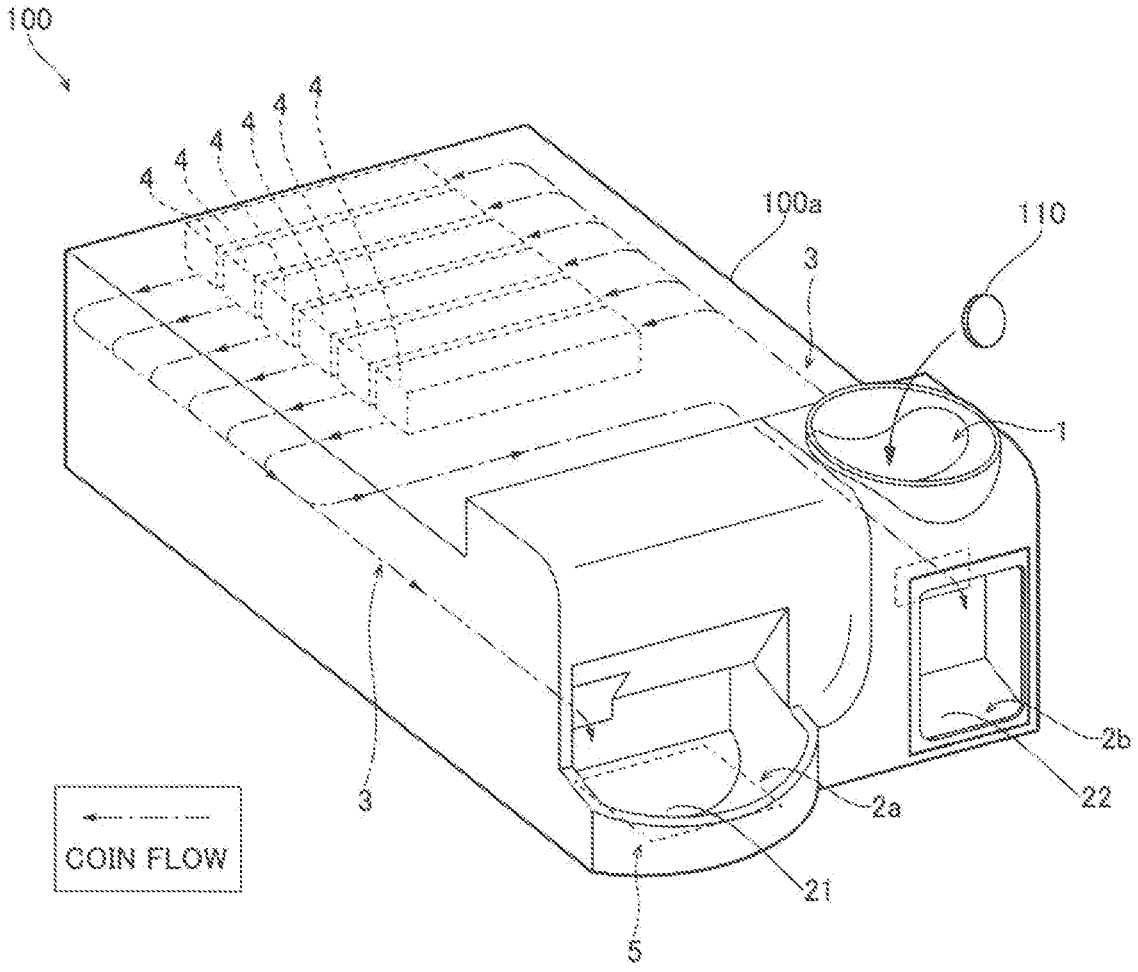
FIG. 1 is a perspective view showing a coin processing device according to an embodiment.

As shown in FIG. 1, the coin processing device 100 is a device that performs input and output of coins 110. The coin processing device 100 constitutes a part of a POS system including a POS (point of sales) register, a bill processing device, a coin roll container, etc., for example. The coin processing device 100 is installed in a store such as a supermarket or a convenience store, for example.

The coin processing device 100 includes an insertion slot 1, two discharge ports 2*a* and 2*b*, a coin transfer unit 3, and coin containers 4. The insertion slot 1 is an entrance through which the coins 110 are inserted from the outside to the inside of a housing 100*a* of the coin processing device 100. The insertion slot 1 communicates with the inside of the housing 100*a* of the coin processing device 100. The discharge ports 2*a* and 2*b* are exits through which the coins 110 are discharged from the inside to the outside of the housing 100*a* of the coin processing device 100. The discharge port 2*a* is a discharge port through which the coins 110 for change are discharged. The discharge port 2*b* is a discharge port through which the return coins 110 are discharged. The discharge ports 2*a* and 2*b* communicate with the inside of the housing 100*a* of the coin processing device 100. The discharge port 2*a* includes a tray 21 as a coin retaining unit. The tray 21 receives and stores the discharged coins 110. The tray 21 is an example of a "coin retaining unit" in the claims. The coin retaining unit may be a coin retaining unit other than the tray 21 as long as the same is a portion of the coin processing device 100 in which the coins 110 are retained and that requires detection of the coins 110. For example, the coin retaining unit may be a predetermined portion of a transfer path of the coin transfer unit 3. Furthermore, the coin retaining unit may be a coin receiving unit 22 of the discharge port 2*b* of the return coins 110. FIG. 1 shows an example in which a coin detection antenna 5 described below is provided at a location corresponding to the tray 21 of the discharge port 2*a*.

The coin transfer unit 3 transfers the coins 110 inside the housing 100*a* of the coin processing device 100. The coin transfer unit 3 includes a belt mechanism that transfers the coins 110, for example. The coin transfer unit 3 transfers the coins 110 inserted through the insertion slot 1 toward the coin containers 4. The coins 110 transferred toward the coin containers 4 are contained in the coin containers 4 corresponding to denominations in a state where the coins 110 are sorted by a sorting unit (not shown) that sorts the coins 110 per denomination. Furthermore, the coin transfer unit 3 transfers the coins 110 contained in the coin containers 4 toward the discharge port 2*a* or 2*b*. The coin transfer unit 3 transfers the coins 110 (coins 110 for change) for the amount obtained by subtracting a product price from the input money amount toward the discharge port 2*a*, for example.

The coin containers 4 contain the coins 110. The coin containers 4 are provided for each denomination. The coin containers 4 include a coin container that contains 1-yen coins, a coin container that contains 50-yen coins, a coin container that contains 5-yen coins, a coin container that contains 100-yen coins, a coin container that contains 10-yen coins, and a coin container that contains 500-yen coins, for example. The denominations of the coins 110 to be processed by the coin processing device 100 are not restricted to the Japanese denominations, but may be the denominations of any country.

The coin processing device 100 includes the coin detection antenna 5 that detects whether or not the coins 110 (see FIG. 3) remain in the coin retaining unit (the presence or absence of the coins 110). The coin detection antenna 5 is provided at a location in the coin processing device 100 (a location that overlaps the coin retaining unit, for example) corresponding to the coin retaining unit (such as the tray 21) in which the coins are retained.

Figure 2:
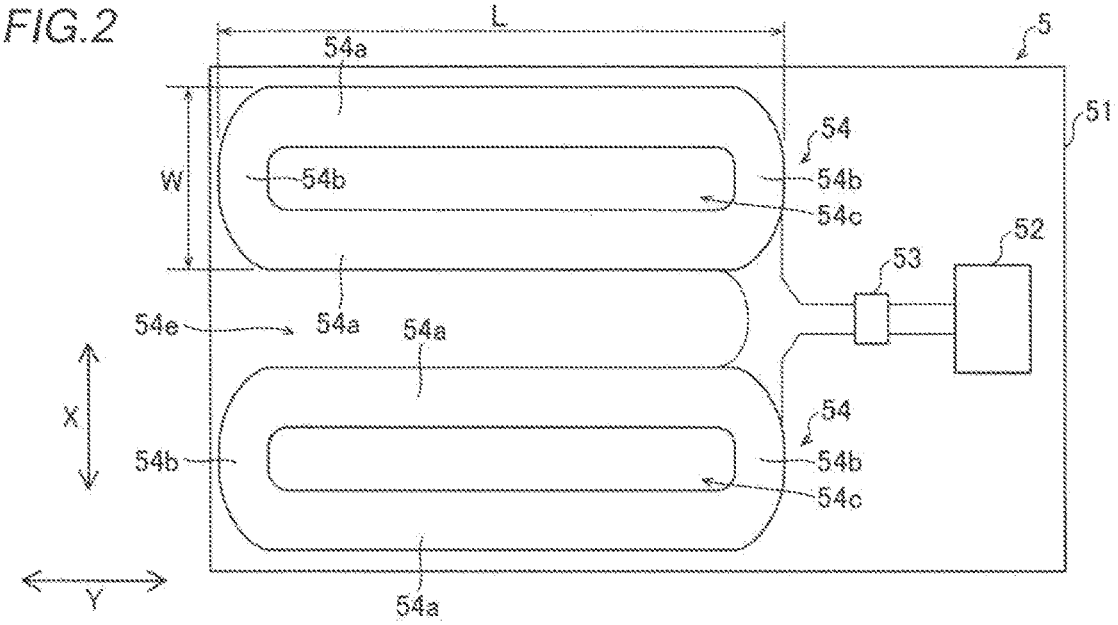
FIG. 2 is a diagram showing a coin detection antenna according to the embodiment.

As shown in FIG. 2, the coin detection antenna 5 includes a substrate 51, a connector 52, a capacitor 53, and a plurality of (two) air core coils 54. The substrate 51 is a rigid circuit board made of resin, on which a wiring pattern is provided. The connector 52, the capacitor 53, and the plurality of air core coils 54 are provided on one substrate 51. The connector 52 is connected to an AC power source (not shown). The connector 52 supplies AC power from the AC power source to the capacitor 53 and the air core coils 54. The capacitor 53 is a resonance capacitor. The capacitor 53 and the air core coils 54 constitute a resonance circuit. The plurality of air core coils 54 is connected in series.

The air core coils 54 each include a spiral wiring pattern provided on the substrate 51. The air core coils 54 are energized to generate magnetic fields. The magnetic fields are circularly generated around the wiring patterns of the air core coils 54. The magnetic fields are oriented in a direction substantially perpendicular to the air core coils 54 in the vicinity of air cores 54*c* of the air core coils 54 described below. The magnetic fields are oriented in a direction substantially parallel to the air core coils 54 in the vicinity of linear portions 54*a* and arcuate portions 54*b* of the air core coils 54 described below.

Whether or not the coins 110 remain in the coin retaining unit is detected based on the fact that the generated magnetic fields are blocked by the coins 110. Specifically, whether or not the coins 110 remain in the coin retaining unit is detected based on a change of the resonance frequency from the reference frequency due to the magnetic fields blocked by the coins 110.

Each of the air core coils 54 is a track-shaped (rounded rectangular) coil having a short-side direction in a direction X and a longitudinal direction in a direction Y. Each of the air core coils 54 has a width W in the direction X and a length L in the direction Y. The width W is smaller than the length a (see FIG. 3) of a detection range 6 (described below) along the short-side directions (direction X) of the air cores 54*c*. The length L is substantially the same as the length e of the detection range 6 along the longitudinal direction (direction Y) of the air cores 54*c*.

Each of the air core coils 54 includes the linear portions 54*a*, the arcuate portions 54*b*, and the air core 54*c*. The linear portions 54*a* are linearly formed portions of the air core coils 54. A pair of linear portions 54*a* faces each other in the direction X (the short-side direction of the air core 54*c*) with the air core 54*c* interposed therebetween. The arcuate portions 54*b* are arcuately formed portions of the air core coils 54. A pair of arcuate portions 54*b* faces each other in the direction Y (the longitudinal direction of the air core 54*c*) with the air core 54*c* interposed therebetween. On one side and the other side in the direction Y, the pair of arcuate portions 54*b* connects the pair of linear portions 54*a* disposed at a distance in the direction X. The air core 54*c* is a portion of the air core coil 54 defined by the inner edges of the linear portions 54*a* and the arcuate portions 54*b*. The air core 54*c* has an elongated hole shape (elongated oval shape, rounded rectangular shape). Both sides of the air core 54*c* in the direction X are linear, and both ends of the air core 54*c* in the direction Y are arcuate. The air core 54*c* is provided on the innermost side of the air core coil 54. The air core 54*c* is provided substantially at the center position of the air core coil 54.

Figure 3:
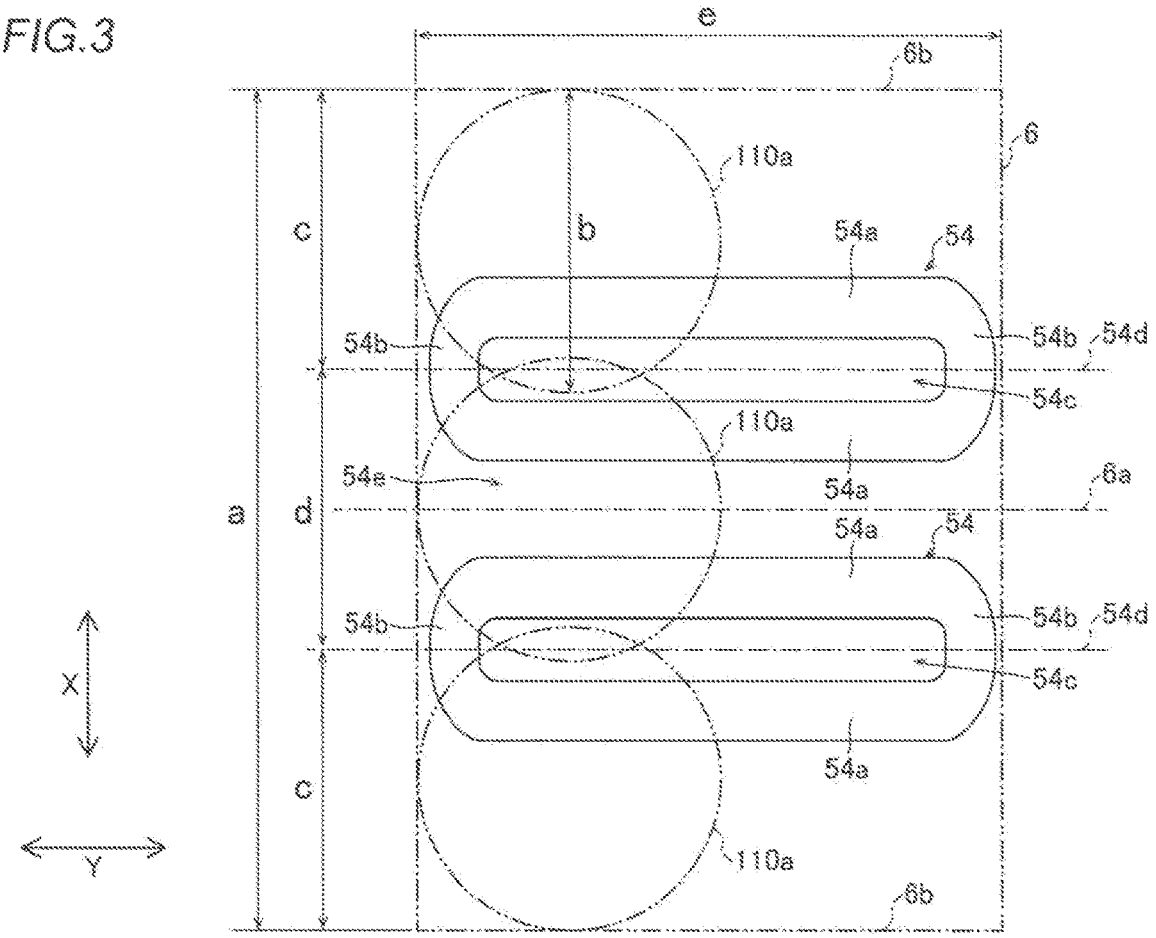
FIG. 3 is a diagram showing an air core coil of the coin detection antenna according to the embodiment and the smallest coins.

According to the present embodiment, as shown in FIG. 3, the plurality of (two) air core coils 54 is disposed along the short-side directions (direction X) of the air cores 54*c* such that the smallest coin 110*a* (the smallest coin 110*a* laid flat on the coin detection antenna 5) of the coins 110 to be detected crosses the centerline(s) 54*d* of the air core(s) 54*c* of the air core coil(s) 54 even when the smallest coin 110*a* is located at any location in the detection range 6. The detection range 6 is a predetermined range for detecting the coins 110. The detection range 6 is a range in which the smallest coin 110*a* can move in the coin retaining unit, for example. The centerlines 54*d* of the air cores 54*c* are the centerlines of the air cores 54*c* in the short-side directions. The centerlines 54*d* of the air cores 54*c* extend along the longitudinal direction (direction Y) of the air cores 54*c*. In FIG. 3, the centerlines 54*d* of the air cores 54*c* and the centerline 6*a* (described below) of the detection range 6 are indicated by one-dot chain lines, and the smallest coin 110*a* and the detection range 6 are indicated by two-dot chain lines.

According to the present embodiment, the number of the plurality of air core coils 54 satisfies the following formula (4):

$$a/b-1 \leq x < a/b \quad (4)$$

where a represents the length of the detection range along the short-side directions of the air cores, b represents the diameter of the smallest coin, and x represents the number of air core coils (x is a positive integer).

When the length a of the detection range 6 along the short-side directions of the air cores 54*c* with respect to the diameter b of the smallest coin 110*a* is 2.5 (=a/b), for example, a number x of air core coils 54 satisfying $1.5 \leq x < 2.5$ becomes two. In this case, two air core coils 54 are provided on the substrate 51.

The plurality of air core coils 54 is disposed substantially evenly in the direction X with respect to the centerline 6*a* of the detection range 6. That is, the plurality of air core coils 54 is line-symmetrical with respect to the centerline 6*a* of the detection range 6. Thus, variations in sensitivity within the detection range 6 can be further significantly reduced or prevented. The air core coil 54 on one side in the direction X with respect to the centerline 6*a* of the detection range 6 and the air core coil 54 on the other side in the direction X with respect to the centerline 6*a* of the detection range 6 are disposed at substantially equal distances in the direction X from the centerline 6*a* of the detection range 6. In addition, the air core coils 54 disposed at opposite ends are disposed at substantially equal distances (distances c at the center positions) in the direction X from the outer edges 6*b* of the detection range 6. The centerline 6*a* of the detection range 6 is the centerline of the detection range 6 in the direction X. The centerline 6*a* of the detection range 6 extends along the direction Y.

According to the present embodiment, the air core coils 54 disposed at opposite ends are disposed such that each of the distances c between the centerlines 54*d* of the air cores 54*c* and the outer edges 6*b* of the detection range 6 along the short-side directions (direction X) of the air cores 54*c* is less than the diameter b of the smallest coin 110*a*. That is, even when the smallest coins 110*a* are disposed on the sides closest to the outer edges 6*b* in the detection range 6, the air core coils 54 disposed at opposite ends are disposed such that the smallest coins 110*a* cross the centerlines 54*d* of the air cores 54*c* of the air core coils 54.

According to the present embodiment, the adjacent air core coils 54 are disposed such that a distance d between the centerlines 54*d* of the air cores 54*c* along the short-side directions of the air cores 54*c* is less than the diameter b of the smallest coin 110*a*. That is, the adjacent air core coils 54 are disposed such that the smallest coin 110*a* crosses the centerlines 54*d* of the air cores 54*c* of both of the adjacent air core coils 54 when the smallest coin 110*a* is disposed substantially at a center position between the adjacent air core coils 54 in the direction X.

Figure 4:
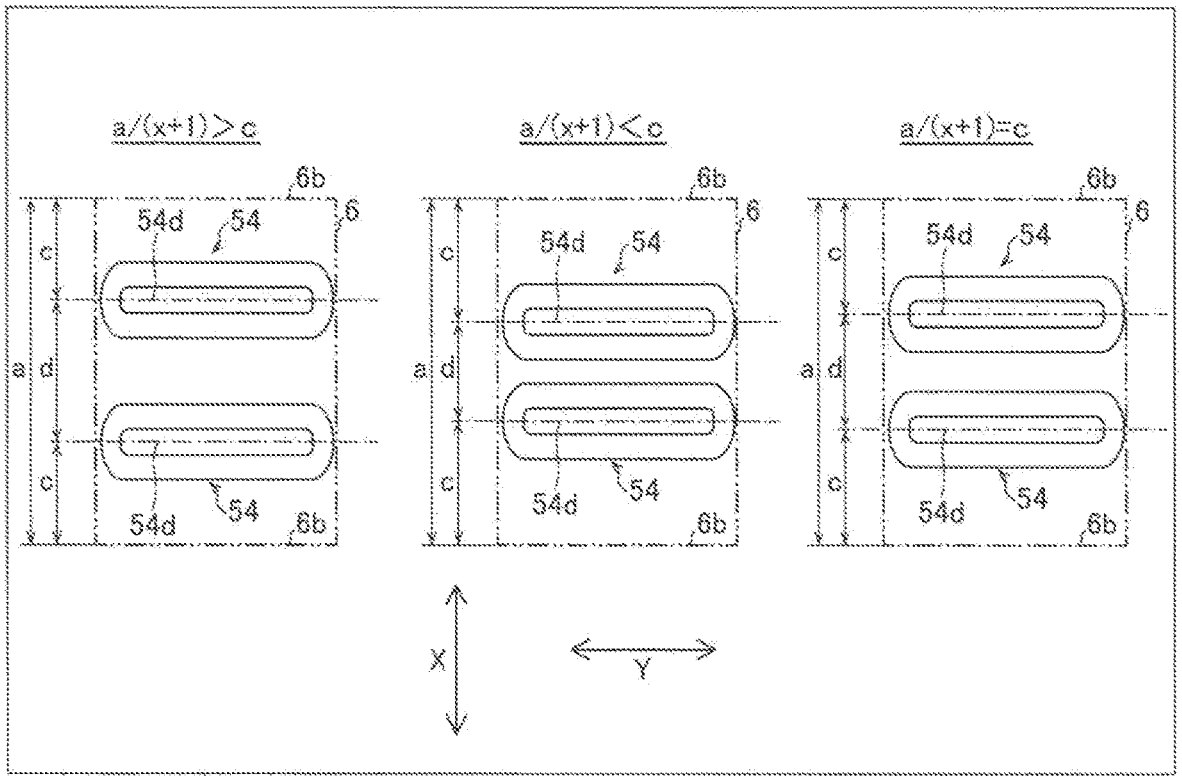
FIG. 4 is a diagram showing arrangements of the air core coil of the coin detection antenna according to the embodiment.

As shown in FIG. 4, the air core coils 54 disposed at opposite ends are disposed such that the distances c between the centerlines 54*d* of the air cores 54*c* and the outer edges 6*b* of the detection range 6 along the short-side directions (direction X) of the air cores 54*c* satisfy the following formula (5), for example.

$$a/(x+1) > c \quad (5)$$

In this case, the adjacent air core coils 54 are disposed such that the distance d between the centerlines 54*d* of the air cores 54*c* along the short-side directions of the air cores 54*c* satisfies the following formula (6).

$$a/(x+1) < d \quad (6)$$

Furthermore, the air core coils 54 disposed at opposite ends are disposed such that the distances c between the centerlines 54*d* of the air cores 54*c* and the outer edges 6*b* of the detection range 6 along the short-side directions (direction X) of the air cores 54*c* satisfy the following formula (7), for example.

$$a/(x+1)<c \quad (7)$$

In this case, the adjacent air core coils 54 are disposed such that the distance d between the centerlines 54*d* of the air cores 54*c* along the short-side directions of the air cores 54*c* satisfies the following formula (8).

$$a/(x+1)>d \quad (8)$$

Furthermore, the air core coils 54 disposed at opposite ends are disposed such that the distances c between the centerlines 54*d* of the air cores 54*c* and the outer edges 6*b* of the detection range 6 along the short-side directions (direction X) of the air cores 54*c* satisfy the following formula (9), for example.

$$a/(x+1)=c \quad (9)$$

In this case, the adjacent air core coils 54 are disposed such that the distance d between the centerlines 54*d* of the air cores 54*c* along the short-side directions of the air cores 54*c* satisfies the following formula (10).

$$a/(x+1)=d \quad (10)$$

<First Example of Winding Direction of Air Core Coil>

Figure 5:
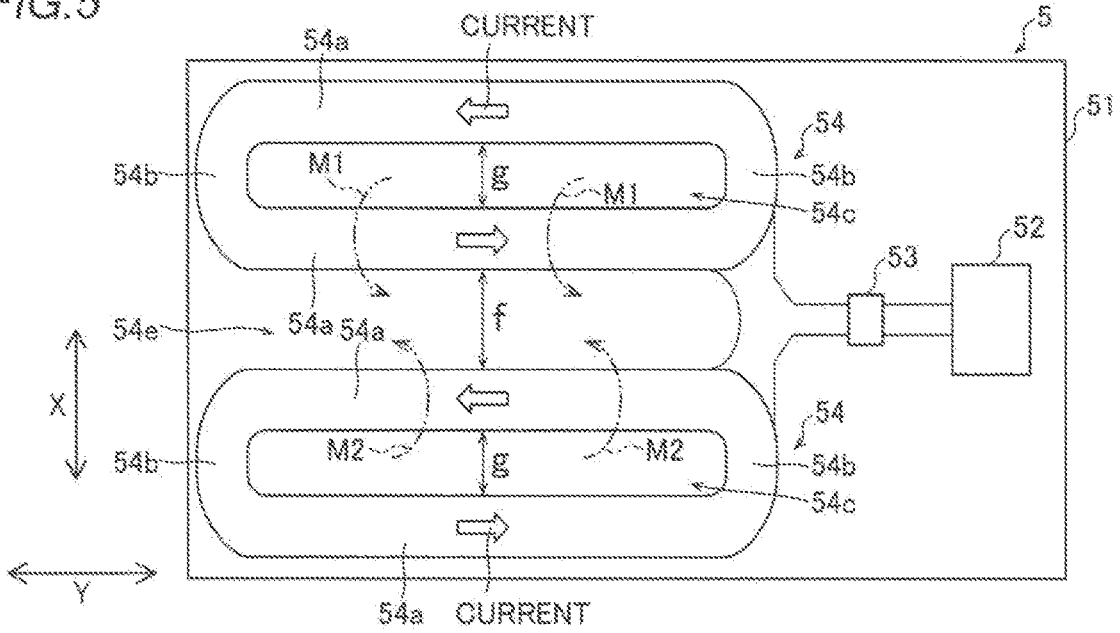
FIG. 5 is a diagram showing a first example of the winding direction of the air core coil of the coin detection antenna according to the embodiment.
Figure 6:
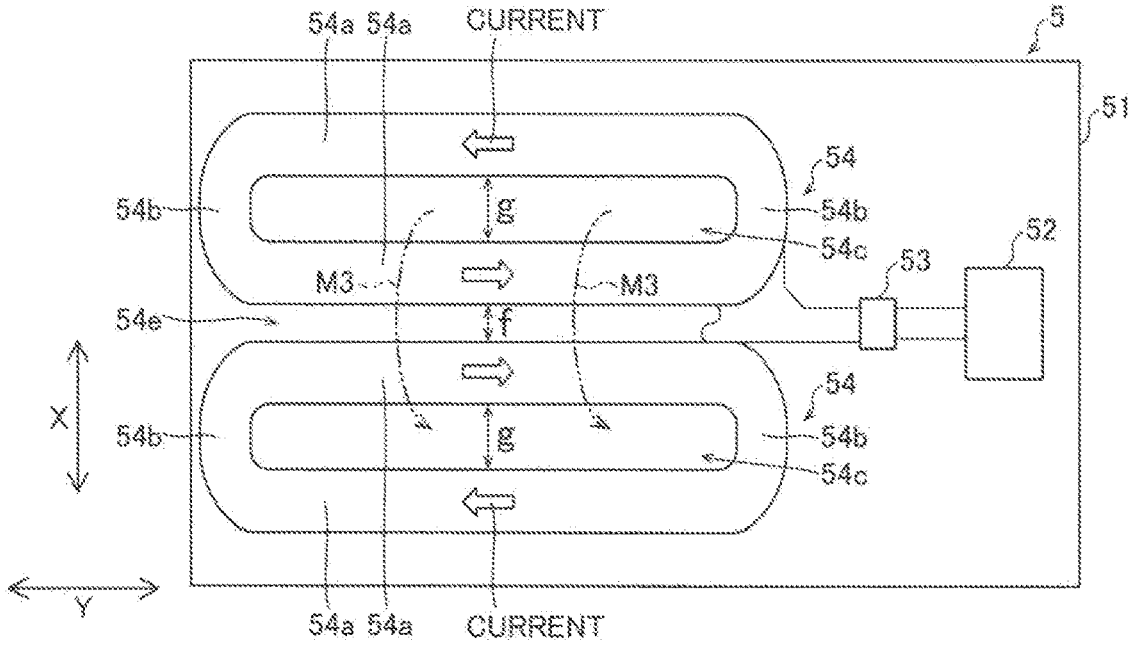
FIG. 6 is a diagram showing a second example of the winding direction of the air core coil of the coin detection antenna according to the embodiment.

FIG. 5 shows the coin detection antenna 5 in which the size f of a gap 54*e* between the adjacent air core coils 54 is larger than the width g of each of the air cores 54*c* in the short-side directions (direction X). In this case, the plurality of air core coils 54 is disposed along the short-side directions of the air cores 54*c* such that the air core coils 54 in which current flow directions in adjacent portions (adjacent linear portions 54*a*) are opposite to each other (the winding directions are the same as each other) are adjacent to each other. Thus, in the gap 54*e* between the adjacent air core coils 54, the direction of a magnetic field M1 generated in one of the adjacent portions (adjacent linear portions 54*a*) and the direction of a magnetic field M2 generated in the other of the adjacent portions (adjacent linear portions 54*a*) are the same as each other. That is, in the gap 54*e* between the adjacent air core coils 54, the magnetic fields M1 and M2 can be generated in the directions in which the magnetic fields M1 and M2 do not cancel out each other (in the directions in which the magnetic fields M1 and M2 strengthen each other). In FIGS. 5 and 6, current that flows through the air core coils 54 and the magnetic fields (indicated by two-dot chain lines) generated by the air core coils 54 are indicated by arrows.

<Second Example of Winding Direction of Air Core Coil>

FIG. 6 shows the coin detection antenna 5 in which the size f of the gap 54*e* between the adjacent air core coils 54 is smaller than ½ of the width g of each of the air cores 54*c* in the short-side directions (direction X). In this case, the plurality of air core coils 54 is disposed along the short-side directions of the air cores 54*c* such that the air core coils 54 in which the current flow directions in the adjacent portions (adjacent linear portions 54*a*) are the same as each other (the winding directions are opposite to each other) are adjacent to each other. Thus, magnetic fields can be synthesized such that a magnetic field generated in one of the adjacent portions (adjacent linear portions 54*a*) and a magnetic field generated in the other of the adjacent portions (adjacent linear portions 54*a*) are connected to each other, and thus a magnetic field M3 that connects the air cores 54*c* of the adjacent air core coils 54 can be generated.

When the size f of the gap 54*e* between the adjacent air core coils 54 is at least ½ of the width g of each of the air cores 54*c* in the short-side directions (direction X) and not more than the width g of each of the air cores 54*c* in the short-side directions (direction X), the plurality of air core coils 54 may be disposed along the short-side directions of the air cores 54*c* such that the air core coils 54 in which the current flow directions in the adjacent portions are the same as each other are adjacent to each other, or the air core coils 54 in which the current flow directions in the adjacent portions are opposite to each other are adjacent to each other.

Advantageous Effects of Present Embodiment

According to the present embodiment, the following advantageous effects are achieved.

According to the present embodiment, as described above, the coin detection antenna 5 includes the plurality of air core coils 54 of track shape such that the coins 110 can be detected in a wide range as compared with the case where the coin detection antenna 5 includes only one air core coil 54 of track shape. Furthermore, the plurality of air core coils 54 is disposed along the short-side directions of the air cores 54*c* such that the smallest coin 110*a* crosses the centerline(s) 54*d* of the air core(s) 54*c* of the air core coil(s) 54 even when the smallest coin 110*a* of the coins 110 to be detected is located at any location in the detection range 6, and thus the coins 110 to be detected can surely be located at the edges of the air cores 54*c* having high sensitivity within the detection range 6. Consequently, even when the plurality of air core coils 54 of track shape is used, variations in sensitivity depending on the positions of the coins 110 relative to the air core coils 54 can be significantly reduced or prevented. Consequently, when the plurality of air core coils 54 of track shape is used, the coins 110 can be detected in a wide range while variations in sensitivity are significantly reduced or prevented. Furthermore, in order to detect the coins 110 in a wide range, it is only necessary to provide one substrate 51 on which the plurality of air core coils 54 is provided, and it is not necessary to provide a plurality of substrates 51 on which the air core coils 54 are provided, and thus the structural complexity of the coin detection antenna 5 can be significantly reduced or prevented. Furthermore, the plurality of air core coils 54 is disposed along the short-side directions of the air cores 54*c* such that generation of a dead space can be prevented as small as possible, and thus the size of the substrate 51 can be reduced. Consequently, even when the plurality of air core coils 54 is provided, the size of the coin detection antenna 5 can be reduced.

According to the present embodiment, as described above, the number of the plurality of air core coils 54 satisfies the above formula (4). Thus, even when the smallest coin 110*a* is located at any location in the detection range 6, the condition that the smallest coin 110*a* crosses the centerline(s) 54*d* of the air core(s) 54*c* of the air core coil(s) 54 can be satisfied with a minimum number of air core coils 54. Consequently, the coins 110 can be detected in a wide range with a minimum number of air core coils 54. Furthermore, even when the plurality of air core coils 54 is provided, the size of the coin detection antenna 5 can be further reduced.

According to the present embodiment, as described above, the air core coils 54 disposed at opposite ends are disposed such that each of the distances c between the centerlines 54*d* of the air cores 54*c* and the outer edges 6*b* of the detection range 6 along the short-side directions is less than the diameter b of the smallest coin 110*a*. Furthermore, the adjacent air core coils 54 are disposed such that the distance d between the centerlines 54*d* of the air cores 54*c* along the short-side directions is less than the diameter b of the smallest coin 110*a*. Thus, the plurality of air core coils 54 can be reliably disposed at a location where the condition that the smallest coin 110*a* crosses the centerline(s) 54*d* of the air core(s) 54*c* of the air core coil(s) 54 even when the smallest coin 110*a* is located at any location in the detection range 6 is satisfied.

According to the present embodiment, as described above, the air core coils 54 disposed at opposite ends are disposed such that the distances c between the centerlines 54*d* of the air cores 54*c* and the outer edges 6*b* of the detection range 6 along the short-side directions satisfy the above formula (5). Thus, the distances c between the centerlines 54*d* of the air cores 54*c* and the outer edges 6*b* of the detection range 6 along the short-side directions of the air cores 54*c* can be reduced as small as possible. Consequently, when the coins 110 are disposed on the outer edge 6*b* side of the detection range 6, the percentages of portions of the coins 110 that cross the centerline 54*d* of an air core 54*c* of an air core coil 54 disposed closest to the side on which the coins 110 are disposed can be increased. Thus, even when the coins 110 are disposed on the outer edge 6*b* side of the detection range 6, the sensitivity can be increased as much as possible.

According to the present embodiment, as described above, the air core coils 54 disposed at opposite ends are disposed such that the distances c between the centerlines 54*d* of the air cores 54*c* and the outer edges 6*b* of the detection range 6 along the short-side directions satisfy the above formula (7). Thus, the distances c between the centerlines 54*d* of the air cores 54*c* and the outer edges 6*b* of the detection range 6 along the short-side directions of the air cores 54*c* can be increased as much as possible. Consequently, distances between the outer edges 6*b* of the detection range 6 and the outer edges of the substrate 51 can be increased as much as possible, and thus the size of the substrate 51 can be reduced with respect to the detection range 6.

According to the present embodiment, as described above, the plurality of air core coils 54 is disposed along the short-side directions of the air cores 54*c* such that the air core coils 54 in which the current flow directions in the adjacent portions are opposite to each other are adjacent to each other when the size f of the gap 54*e* between the adjacent air core coils 54 is larger than the width g of each of the air cores 54*c* in the short-side directions (see FIG. 5). Here, when the size f of the gap 54*e* between the adjacent air core coils 54 is larger than the width g of each of the air cores 54*c* in the short-side directions (i.e., when the air core coils 54 are disposed away from each other), the air core coils 54 in which the current flow directions in the adjacent portions are the same as each other are adjacent to each other such that magnetic fields are generated in the directions in which the magnetic fields cancel out each other in the gap 54*e* between the adjacent air core coils 54. When magnetic fields are generated in the directions in which the magnetic fields cancel out each other, the sensitivity is disadvantageously reduced. Therefore, as described above, the plurality of air core coils 54 is disposed along the short-side directions of the air cores 54*c* such that the air core coils 54 in which the current flow directions in the adjacent portions are opposite to each other are adjacent to each other when the size f of the gap 54*e* between the adjacent air core coils 54 is larger than the width g of each of the air cores 54*c* in the short-side directions, and thus magnetic fields can be generated in the directions in which the magnetic fields do not cancel out each other (in the directions in which the magnetic fields strengthen each other) in the gap 54*e* between the adjacent air core coils 54. Consequently, sufficient sensitivity for detecting the coins 110 can be ensured also in the gap 54*e* between the adjacent air core coils 54.

According to the present embodiment, as described above, the plurality of air core coils 54 is disposed along the short-side directions of the air cores 54*c* such that the air core coils 54 in which the current flow directions in the adjacent portions are the same as each other are adjacent to each other when the size f of the gap 54*e* between the adjacent air core coils 54 is smaller than ½ of the width g of each of the air cores 54*c* in the short-side directions (see FIG. 6). Here, when the size f of the gap 54*e* between the air core coils 54 is smaller than ½ of the width g of each of the air cores 54*c* in the short-side directions (i.e., when the air core coils 54 are disposed close to each other), the air core coils 54 in which the current flow directions in the adjacent portions are opposite to each other are adjacent to each other such that magnetic fields are generated in the directions in which the magnetic fields cancel out each other in the gap 54*e* between the adjacent air core coils 54. When magnetic fields are generated in the directions in which the magnetic fields cancel out each other, the sensitivity is disadvantageously reduced. Therefore, as described above, the plurality of air core coils 54 is disposed along the short-side directions of the air cores 54*c* such that the air core coils 54 in which the current flow directions in the adjacent portions are the same as each other are adjacent to each other when the size f of the gap 54*e* between the adjacent air core coils 54 is smaller than the width g of each of the air cores 54*c* in the short-side directions, and thus a magnetic field can be generated to connect the air cores 54*c* of the adjacent air core coils 54. Consequently, sufficient sensitivity for detecting the coins 110 can be ensured also in the gap 54*e* between the adjacent air core coils 54.

According to the present embodiment, as described above, the plurality of air core coils 54 is connected in series. Thus, the air core coils 54 can be connected to each other with a simple structure as compared with the case where the plurality of air core coils 54 is connected in parallel.

MODIFIED EXAMPLES

The embodiment disclosed this time must be considered as illustrative in all points and not restrictive. The range of the present invention is not shown by the above description of the embodiment but by the scope of claims for patent, and all modifications (modified examples) within the meaning and range equivalent to the scope of claims for patent are further included.

For example, while the present invention is applied to the coin processing device as a change machine in the aforementioned embodiment, the present invention is not restricted to this. The present invention may alternatively be applied to a coin processing device other than a change machine as long as the coin processing device includes a coin retaining unit and a coin detection antenna.

Figure 7:
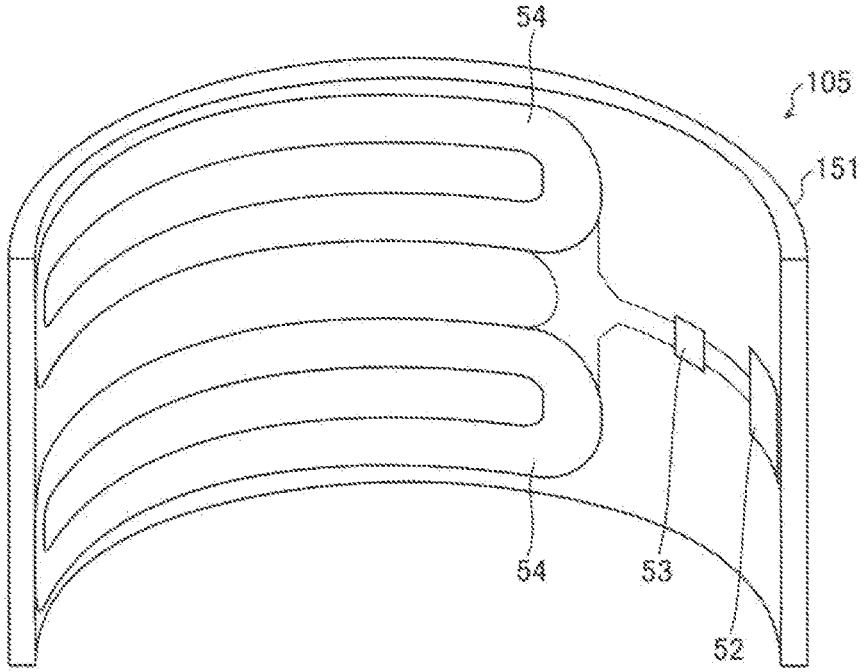
FIG. 7 is a diagram showing a coin detection antenna according to a modified example of the embodiment.

While the air core coils are provided on the rigid circuit board in the aforementioned embodiment, the present invention is not restricted to this. For example, the air core coils may alternatively be provided on a flexible circuit board. In a modified example shown in FIG. 7, a coin detection antenna 105 includes a substrate 151 as a flexible circuit board, a connector 52, a capacitor 53, and a plurality of (two) air core coils 54. The connector 52, the capacitor 53, and the plurality of air core coils 54 are provided on the substrate 151 as a flexible circuit board. The substrate 151 as a flexible circuit board has flexibility and is bendable. In the modified example, the substrate 151 as a flexible circuit board is used such that the coin detection antenna 105 can be disposed at a location corresponding to a coin retaining unit in a state where the coin detection antenna 105 is deformed according to the shape of the coin retaining unit. Consequently, coins in the coin retaining unit can be effectively detected.

While the number of the plurality of air core coils satisfies the above formula (4) in the aforementioned embodiment, the present invention is not restricted to this. For example, the number of the plurality of air core coils may alternatively be larger than the number satisfying the above formula (4).

While the plurality of air core coils is disposed along the short-side directions of the air cores such that the air core coils in which the current flow directions in the adjacent portions are opposite to each other are adjacent to each other when the size of the gap between the adjacent air core coils is larger than the width of each of the air cores in the short-side directions in the aforementioned embodiment, the present invention is not restricted to this. According to the present invention, as long as coins can be detected, the plurality of air core coils may not be disposed along the short-side directions of the air cores such that the air core coils in which the current flow directions in the adjacent portions are opposite to each other are adjacent to each other even when the size of the gap between the adjacent air core coils is larger than the width of each of the air cores in the short-side directions.

While the plurality of air core coils is disposed along the short-side directions of the air cores such that the air core coils in which the current flow directions in the adjacent portions are the same as each other are adjacent to each other when the size of the gap between the adjacent air core coils is smaller than ½ of the width of each of the air cores in the short-side directions in the aforementioned embodiment, the present invention is not restricted to this. According to the present invention, as long as coins can be detected, the plurality of air core coils may not be disposed along the short-side directions of the air cores such that the air core coils in which the current flow directions in the adjacent portions are the same as each other are adjacent to each other even when the size of the gap between the adjacent air core coils is smaller than ½ of the width of each of the air cores in the short-side directions.

While the plurality of air core coils is connected in series in the aforementioned embodiment, the present invention is not restricted to this. According to the present invention, the plurality of air core coils may alternatively be connected in parallel.

While the coin detection antenna includes the two air core coils in the aforementioned embodiment, the present invention is not restricted to this. According to the present invention, the coin detection antenna may alternatively include three or more air core coils.

What is claimed is:

1. A coin detection antenna, comprising:

a circuit substrate; and a plurality of air core coils, each having a track shape portion with a short-side direction and a longitudinal direction, an empty space surrounded with the track shape portion as an air core, and a planar wiring pattern provided on a surface of the circuit substrate, wherein each of the air cores of the plurality of air core coils has a single centerline, the plurality of air core coils is disposed apart from each other along the short-side directions of the air cores of the plurality of air core coils such that a coin having a diameter to be detected by the plurality of air core coils crosses at least one of the centerlines of the air cores, each of the centerlines extending along the longitudinal direction at a center of the air core in the short-side direction, when the coin is located at any location in a detection range, a distance between each of the centerlines of the air cores of the plurality of air core coils disposed at opposite ends and each of outer edges of the detection range in the short-side directions is less than the diameter of the coin, a distance between the centerlines of the air cores of the plurality of air core coils adjacent to each other along the short-side directions is less than the diameter of the coin, and the detection range has a length larger than the diameter of the coin in the short-side directions of the air cores.

2. The coin detection antenna according to claim 1, wherein a number of the plurality of air core coils satisfies a formula $$a/b-1 \leq x < a/b$$

where a represents a length of the detection range along the short-side directions of the air cores, b represents a diameter of the coin, and x represents the number of the plurality of air core coils.

3. The coin detection antenna according to claim 1, wherein the air core coils disposed at the opposite ends are disposed such that the distance between each of the centerlines of the air cores of the air core coils disposed at the opposite ends and each of the outer edges of the detection range in the short-side directions satisfies a formula $$a/(x+1) > c$$

where a represents a length of the detection range along the short-side directions of the air cores, c represents the distance between each of the centerlines of the air cores of the air core coils disposed at the opposite ends and each of the outer edges of the detection range in the short-side directions of the air cores, and x represents a number of the plurality of air core coils.

4. The coin detection antenna according to claim 1, wherein the air core coils disposed at the opposite ends are disposed such that the distance between each of the centerlines of the air cores of the air core coils disposed at the opposite ends and each of the outer edges of the detection range in the short-side directions satisfies a formula $$a/(x+1) < c$$

where a represents a length of the detection range along the short-side directions of the air cores, c represents the distance between each of the centerlines of the air cores of the air core coils disposed at the opposite ends and each of the outer edges of the detection range in the short-side directions of the air cores, and x represents a number of the plurality of air core coils.

5. The coin detection antenna according to claim 1, wherein the plurality of air core coils is disposed along the short-side directions of the air cores such that current flow directions in adjacent portions of the air core coils are opposite to each other when a distance between the air core coils adjacent to each other in the short-side directions is larger than a width of each of the air cores in the short-side directions.

6. The coin detection antenna according to claim 1, wherein the plurality of air core coils is disposed along the short-side directions of the air cores such that current flow directions in adjacent portions of the air core coils are same as each other when a distance between the air core coils adjacent to each other in the short-side directions is smaller than ½ of a width of each of the air cores in the short-side directions.

7. The coin detection antenna according to claim 1, wherein the plurality of air core coils is connected in series.

8. The coin detection antenna according to claim 1, wherein the circuit substrate is a flexible circuit board having a flexibility to be bent, and the flexible circuit board is bent to effectively detect the coins.

9. The coin detection antenna according to claim 1, wherein the coin restrictively moves on the coin detection antenna to define the detection range, and the detection range has a length in the longitudinal direction substantially same as that of each of the plurality of air core coils in the longitudinal direction and larger than the diameter of the coin.

10. A coin processing device comprising:

a coin retaining unit; and a coin detection antenna provided at a location corresponding to the coin retaining unit, wherein the coin detection antenna includes:

a circuit substrate; and a plurality of air core coils, each having a track shape portion with a short-side direction and a longitudinal direction, an empty space surrounded with the track shape portion as an air core, and a planar wiring pattern provided on a surface of the circuit substrate, each of the air cores of the plurality of air core coils has a single centerline, the plurality of air core coils is disposed apart from each other along the short-side directions of the air cores of the plurality of air core coils such that a coin having a diameter to be detected by the plurality of air core coils crosses at least one of the centerlines of the air cores, each of the centerlines extending along the longitudinal direction at a center of the air core in the short-side direction, when the coin is located at any location in a detection range, a distance between each of the centerlines of the air cores of the air core coils disposed at opposite ends and each of outer edges of the detection range in the short-side directions is less than the diameter of the coin, a distance between the centerlines of the air cores of the air core coils adjacent to each other along the short-side directions is less than the diameter of the coin, and the detection range has a length larger than the diameter of the coin in the short-side directions of the air cores.

11. The coin processing device according to claim 10, wherein the coin retaining unit has an area in which the coin restrictively moves, and the area of the coin retaining unit is defined as the detection range, and the detection range has a length in the longitudinal direction substantially same as that of each of the plurality of air core coils in the longitudinal direction and larger than the diameter of the coin.

* * * * *